United States Patent [19]

Belbel et al.

[11] Patent Number: 4,467,298

[45] Date of Patent: Aug. 21, 1984

[54] AUTOMATIC SHORT-CIRCUIT CURRENT LIMITING DEVICE

[75] Inventors: Elie Belbel, Vaucresson; Louis Féchant, Le Vesinet; André Haury, Le Raincy; Michel Lauraire, Courbevoie; Lucien Siffroi, Versailles, all of France

[73] Assignee: La Telemecanique Electrique, France

[21] Appl. No.: 405,829

[22] Filed: Aug. 6, 1982

[30] Foreign Application Priority Data

Aug. 7, 1981 [FR] France ..... 81 15573

[51] Int. Cl.[3] ..... H01H 77/10

[52] U.S. Cl. ..... 335/16; 200/151; 335/147

[58] Field of Search ..... 335/16, 147, 195; 200/151

[56] References Cited

U.S. PATENT DOCUMENTS 3,147,358 3/1960 Melhart ..... 200/151
3,815,059 6/1974 Spoelman ..... 335/16
4,346,357 8/1982 Kussy et al. ..... 335/16

FOREIGN PATENT DOCUMENTS 1788148 5/1973 Fed. Rep. of Germany ..... 335/195
6705661 10/1967 Netherlands ..... 200/151

*Primary Examiner*—J. D. Miller
*Assistant Examiner*—Jeffrey Sterrett
*Attorney, Agent, or Firm*—William A. Drucker

[57] ABSTRACT

A device is provided comprising a simple means for holding the contacts apart and insulated from each other after circuit breaking.

A screen formed by an insulating plate of small thickness, is placed between two mobile contact levers and is urged by springs against flanges which are integral with the levers and which move apart when short circuit currents appear for allowing this screen to be rapidly projected between the contact inserts.

This simple circuit-breaker device may be used such as it is or in association with a contactor for protecting lines which supply consumer apparatus.

8 Claims, 7 Drawing Figures

AUTOMATIC SHORT-CIRCUIT CURRENT LIMITING DEVICE

BACKGROUND OF THE INVENTION

The invention relates to a limiter switch device comprising two mobile contacts each placed at the end of a contact carrying lever which rocks about a pivot and which is subject to the action of a return spring, the two levers being placed in the same plane and substantially parallel to each other when the switch is closed, so that repulsion forces generated when these very high over currents are flowing through the levers will move the levers away from each other, the device further comprising mechanical means adapted to maintain the contacts separate from each other after the appearance of these over currents.

Such limiter switch devices are advantageously used in association with circuit-breakers for protecting lines which supply current consuming apparatus, more especially when short-circuits occur.

THE PRIOR ART

In known circuit-breaker devices of the above general construction the mechanical catching means for maintaining the contacts separated from each other, only become active if at least one of the levers travels over a relatively long path. It may be feared that the appearance of high currents, which do not however develop repulsion forces capable of causing a minimum travel, is followed by the contacts closing again and that the mechanical resistance offered by these mechanical catching means delays the opening.

Such phenomena are particularly dangerous when these circuit-breakers are placed in series with contactors whose response time to an automatic opening control are substantially longer than those of the circuit-breakers.

Furthermore, known circuit-breakers generally have a relatively complicated structure which is in part due to the complexity of the catching members used for automatically holding the circuit-breaker open and in part due to the complexity of the manual resetting devices.

OBJECT OF THE INVENTION

It is therefore, an object of the present invention to provide a current limiting device whose general structure corresponds to a known arrangement which has given entire satisfaction, but in which novel constructional measures are taken for overcoming the above-mentioned disadvantages of the known art. A more specific object is to provide a limiting device in which the two contacts will be held apart and will be galvanically isolated from each other as soon as a very small space separates them, thus allowing the device to be placed in series with a contactor apparatus.

SUMMARY OF THE INVENTION

A thin insulating screen is placed between the arms of the contact carrying levers and adapted to move in a plane substantially perpendicular to the plane of rotation of these levers. This screen is controlled by a resilient member which tends to project it between the two contact inserts and maintained in a blocked position, where this resilient member is compressed by an abutment surface of the contact levers.

Switch devices are already known, for example, from U.S. Pat. No. 3,168,627, having two mobile contacts placed at the end of a deformable support and an insulating screen which moves therebetween.

In this known device, the movements of the screen are caused by a coil and by a compression spring so as to operate as a remote control switch, whereas, because of the connections formed between this screen and the contact supports, operation as a limiter switch is totally excluded.

DESCRIPTION OF THE PREFERRED EMBODIMENT

Figure 1:
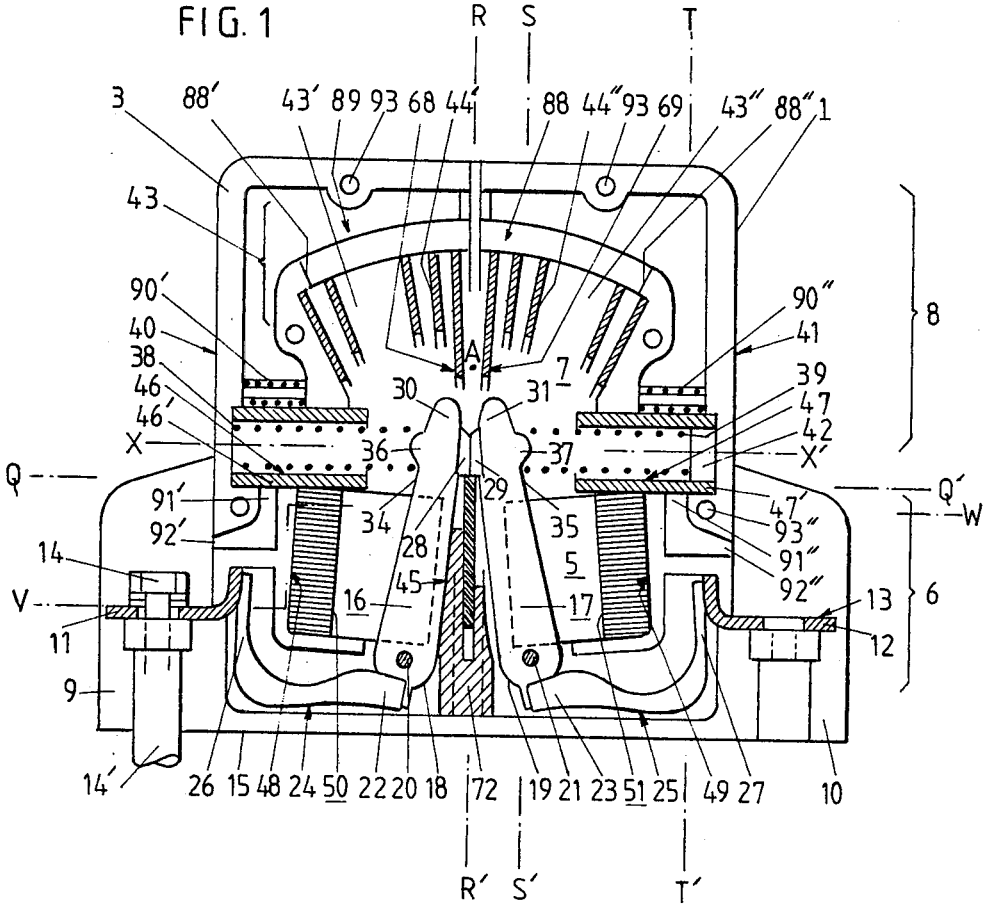
FIG. 1 is an elevational view, in section through plane PP' of FIG. 5 containing the contact levers, of an apparatus constructed in accordance with the invention.

A limiter apparatus in the form, for example, of a single pole case 1 in FIG. 1 and formed, for example, by the association of two half-cases 3,4 which are symmetrical with respect to the plane of the figure, comprises principally a first inner volume 5 placed in a lower region 6 of the case and a second inner volume 7 placed in an upper region 8 of the case. The lower region of the case has an external base surface 15 serving preferably for fixing the apparatus and two lateral opposite extensions 9, 10, which receive respective conductors 11, 12 for the electrical connection of the apparatus, which may be effective, either through zone 13 for connecting this conductor shown at the right hand side of the figure, or by means of connection members using a screw 14 and a socket 14' extending beyond the base. The second lower volume 5 houses two contact levers 16 and 17 each having a first end 18, 19, pivotally mounted about a pivot 20, 21. These two pivots have parallel axes perpendicular to a median plane PP' in which the levers may rock and are placed in the vicinity of the base 15.

Figure 2:
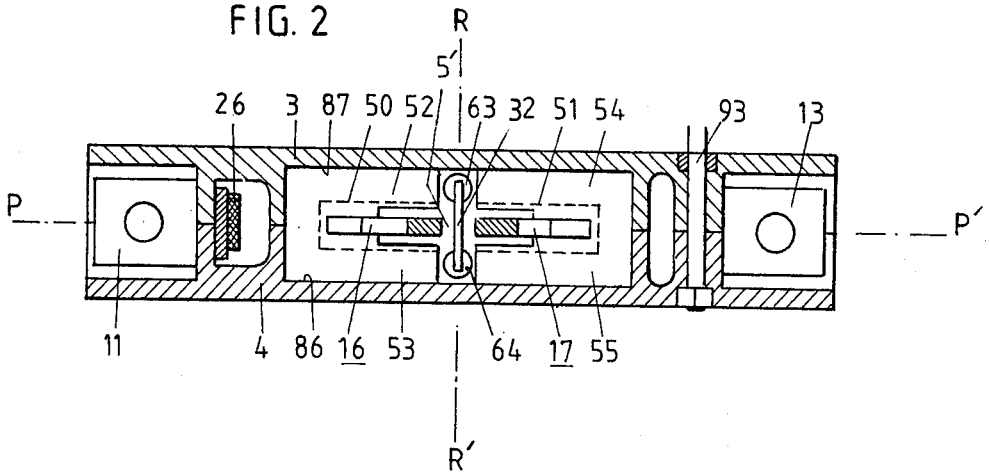
FIG. 2 is a top view of the apparatus of FIG. 1, in section through a broken plane VW.

This plane PP' advantageously is the plane for sealing the two half-cases 3, 4, see FIG. 2.

Each first lever end 18, 19, is connected to a connecting conductor by means of a braided metal strip, or equivalent deformable conductor 22, 23, the first portion of which, 24, 25, extends substantially parallel to the base.

The first ends 18, 19 are placed in the vicinity of the pivots so that the movements of the contact levers only cause slight deformation of the second portions 26, 27 of these braided metal conductors, which are themselves substantially perpendicular to base 15 and are connected through parts 11, 13.

Contact inserts 28, 29 are placed at the second ends, 30, 31, of the arms of the levers which are opposite those receiving the braided metal conductors. These arms are disposed substantially parallel to each other and opposite each other, perpendicularly to base 15.

The edges 34, 35 of these ends which are opposite the contact inserts have respective bosses 36, 37. Two contact pressure springs 38, 39, extending substantially about a common axis XX', parallel to the base 15 and placed in the median plane on a boss 36-37 and on a lateral wall, 40, 41 of the case. These two walls are substantially parallel to the arms of the levers and are substantially parallel to plane RR' of the case which is perpendicular to the base and which separates the two pivots and the two levers in a symmetrical arrangement.

Spring 39 may possibly bear on the adjacent wall 41 through an adjusting piece 42.

These two springs apply to the levers opposite pressure forces which maintain the inserts against each other so that the two levers take up substantially symmetrical positions with respect to plane RR' passing between the pivots perpendicularly to plane PP'.

An arc chute 43, placed in the second inner volume 7, comprises a multiplicity of forked fins 44, disposed preferably so as to radiate away from the contacts, in order to receive and to divide up an arc appearing between the ends of the levers during a power cut.

These fins may be held in place either by shaped surfaces integrally molded with the insulating half-cases 3, 4, or be disposed inside a separate arc case placed inside the first volume 7.

Springs 38, 39 may also be either guided in half-housings 46, 47 of the half-cases, or be placed in guide sockets 46', 47' nipped between the half-cases and comprising these housings.

Figure 3:
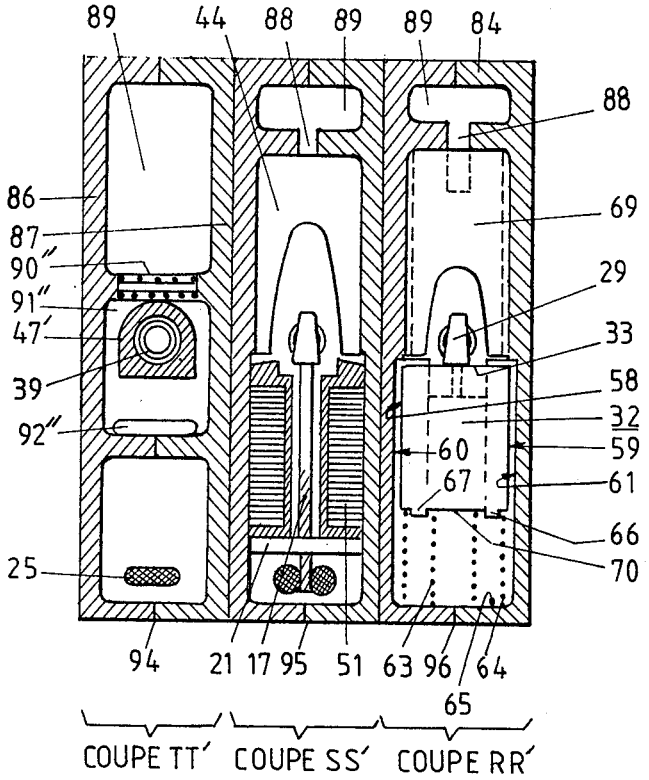
FIG. 3 is a side view of a circuit-breaker apparatus comprising three devices built in accordance with FIG. 1, each shown in section through planes RR', SS' and TT'.

In lateral zones 48, 49 of the first inner volume 5, placed between the braided metal conductors and the springs, are disposed two magnetic pieces 50, 51, each in the form of a U whose legs, 52, 53 and 54, 55 surround at least partially the arms of the levers, see FIGS. 1, 2 and 3. These magnetic pieces are held in place by relief or hollow shapes carried by the half-cases.

Figure 4:
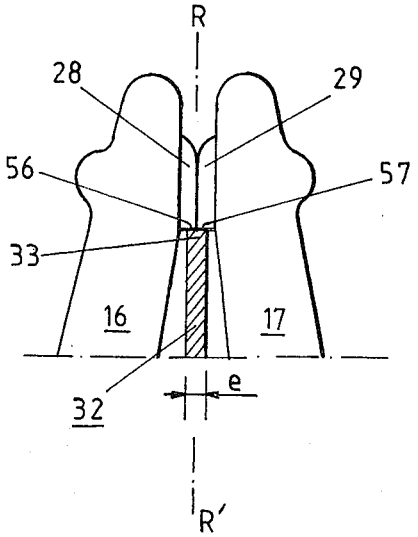
FIG. 4 shows in elevation a detail of the levers at their contact regions.

The contact inserts 28, 29 each have a transverse flange, 56, 57, placed on the same side as the corresponding pivot, these two flanges being substantially orientated so as to form an extension of each other, see FIG. 4.

In a central zone 5' of the first volume 5 which is included between the contact levers and the magnetic pieces, is disposed a screen 32 which is in the form of a rectangular plate of small thickness "e" made from an insulating material, see also FIGS. 2 and 3.

Figure 6:
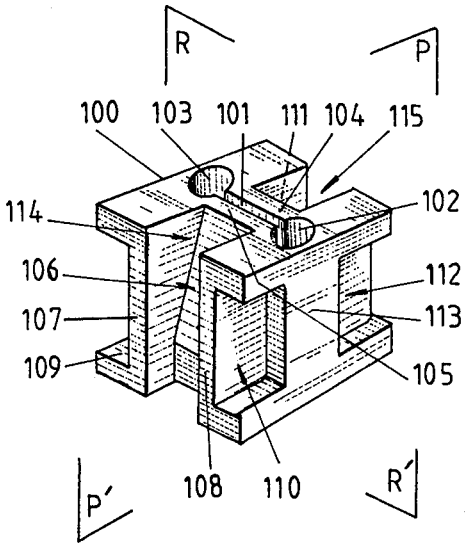
FIG. 6 shows in perspective an insert piece adapted to guide the screen and the springs.

This screen, whose own plane is placed in the plane RR', may move in this plane either by means of two lateral opposite and parallel edges 58, 59 which are guided in two opposite guide grooves 60, 61 forming baffles which separate the two levers 16, 17 and carried respectively by an internal surface of each half-case, see FIG. 3, or in an appropriate guide space, see FIG. 6 described further on.

An upper edge 33 of this screen is placed against at least one, and possibly both, transverse flanges 56, 57 of the contact inserts forming mobile stops, and is held in this position by means of two compressed springs 63, 64, with parallel axes, which are applied to a bottom 65 of the case carrying base 15 and to two bearing points 66, 67 of the screen, opposite the upper edge 33 and adjacent to the lateral guide edges 58, 59.

The two guide grooves extend sufficiently in the direction of the arc chamber for the insulating screen to be able to move under the effect of the springs and to reach a position further removed from the bottom where the upper edge reaches point A, see FIG. 1.

The operation of this circuit-breaker is as follows: when repulsion forces, which are applied to the arms of the levers and whose efficiency is improved by the magnetizable pieces, move the levers apart by an amount slightly greater than the thickness "e", the insulating screen 32 escapes from flanges 56, 57 and is very rapidly propelled between the contact inserts. The passage of this screen results not only in stretching out the arc, which occurs between the contacts, in the direction of the fins, but also in the interpositioning of an obstacle which prevents the contacts from coming into contact again immediately after their separation, and which then provides a partial insulation of two symmetrical half chambers 43', 43'', forming together the whole of chamber 43.

So that the arc may rapidly strike the fins after possibly passing round the upper edge 33 of the screen and may travel rapidly towards the fins 44', 44'' of these half-chambers, two fins 68, 69, longer than the others, may be placed on each side of point A and in the immediate vicinity of this point.

Furthermore, see FIG. 3, the screen may comprise an extension 70 directed towards the bottom of the base of the case, or may have a lower edge sufficiently distant from 33 to avoid the striking of an arc between the lower ends of the lever, this extension being placed for example opposite the transverse rib 72 for forming a baffle.

So that one of the flanges at least, for example flange 57, of one of the levers, for example lever 16, is placed at rest opposite the end 33 of the screen, this lever is placed in abutment against a stop surface 45 of the case, carried for example by a transverse insulating rib 72 which may form part of the case or be carried by a special part as will be seen further on; the lever is pushed by its return spring 38, into a position serving to define also that of the other lever 17 which is subject to the action of its own return spring 39. The two springs must, consequently, have different characteristics so that this abutment at 45 is achieved in all cases. In a preferred embodiment, spring 38 exerts on lever 16, when this latter is at rest, a force directed from left to right, which is greater than the force which is exerted by spring 39 in the opposite direction on lever 17 when contact 29 is in abutment against contact 28. During automatic opening, lever 17 which is the least loaded, will then move away more rapidly than the other one.

The efficiency of the limiter switch device which has just been described comes more especially from the fact that the screen, because of its lightness, is very rapidly propelled between the contacts and that the contact levers are subject to high repulsion forces because of the small distance which may separate these levers when the screen has only a small thickness.

Figure 5:
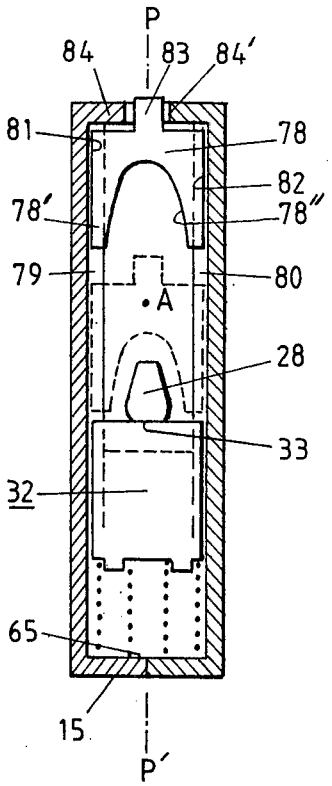
FIG. 5 illustrates a resetting member in a side view through plane RR'.

Resetting of the apparatus, whose purpose is to move the screen from the position corresponding to that where the upper edge 33 is at A to the position shown in FIG. 1, is carried out by means of a flat pusher 78 of small thickness, see FIG. 5. This pusher, which is placed like screen 32 in plane RR', slides downwards by means of two grooves 79, 80 formed in the case which guide its parallel edges 81, 82 when its upper end 83 passing through an opening 84' in the roof 84 is subjected to an appropriate maneuver. This pusher, which is held in the upper position shown in FIG. 5 by resilient means, not shown, also moves between fins 68 and 69; to allow the arc to stretch out between these fins 68, 69 towards the upper part of the chamber, the lower region 78' of this pusher has an indentation 78" so that it does not prevent reclosing of the contacts when the pusher is in a low position shown with a broken line in FIG. 5.

Between the lateral walls 40, 41, the roof 84 opposite base 15, and the longitudinal walls 86, 87 of the case on the one hand, and the shaped surfaces which hold the fins in the arc chute 43, there may be disposed a path for discharging and laminating the gases which appear during automatic power cut-off; such a channel comprises, for example, see FIGS. 1 and 3, an upper opening 88 opposite the levers, and extending in plane PP' between points 88' and 88" where two fins end which are the furthest removed from each other, a first channel 89, possibly obstacles such as 90', 90" in the form of a grid or perforated metal sheets, a second channel, 91', 91", passing for example round the housings 47, 46 of the pressure springs and finally an exhaust port, 92', 92", opening for example into a lateral wall, 41, 40, in the vicinity of terminals 12, 13, see FIG. 3.

The case of the single pole apparatus may advantageously have an elementary shape only containing the elements required for cutting off one phase conductor, so that several elementary cases may be associated side by side when a multiphase line has to be protected, see FIG. 3, for example by means of coupling rods 93, passing through the different cases 94, 95, 96.

Figure 7:
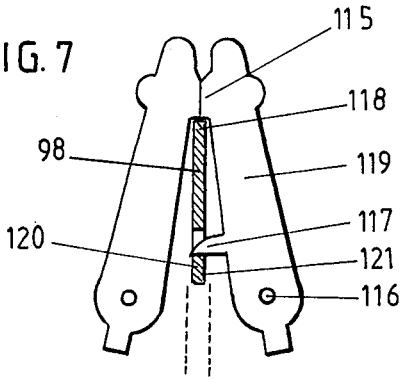
FIG. 7 shows in elevation another embodiment of the screen and the levers.

Since the amplitudes of the movements of the levers are large in the vicinity of the contact inserts, the screen rests advantageously thereon so that its release is immediate. An edge 120 of a screen 98 may however be retained by a hook 117 of lever 119 placed between the contact 115 and pivot 116, such as shown in FIG. 7; in this case, the upper edge 118 of the screen will nevertheless be disposed in the vicinity of the contact inserts so that stretching out of the arc and the galvanic separation occur very rapidly after opening, as in the preceding example. The grooves 60, 61 for guiding the screen, rib 72 and the abutment surface 45 of the contact lever 16 may advantageously be carried by a molded insulating piece shown at 100 in FIG. 6 and being located in the first inner volume 5 between the half-cases at the time of assembly.

This piece 100 here comprises a single groove or space 101 for guiding the screen 32, which is placed in the plane RR' and which ends at two parallel cylindrical housings 102, 103 intended to house the springs 63, 64; this groove 101 is defined by walls 104, 105, substantially parallel to the plane RR', one of which carries the abutment surface 106 corresponding to 45 and which are both connected to two external walls 107, 108 parallel to the median plane PP'.

These walls which locally insulate the contact levers 16, 17 and the metal legs of the magnetic pieces 50 and 51 comprise two pairs of outer open housings 109, 110 and 111, 112 for receiving these legs and cooperating in maintaining the magnetic pieces mechanically in position; two adjacent housings 110, 112, disposed on the same wall such as 108, are separated by a dividing wall such as 113 so as to avoid an arc being inadvertently struck between two magnetic pieces.

Levers 16, 17, move in two notches 114, 115 which are placed between the walls 107, 108 and which end at walls 104, 105.

We claim:

1. A current limiting circuit breaker comprising:

a. an insulating case having a base member, a plane of symmetry substantially at right angles with the said base;

b. first and second levers pivotably mounted in a first inner volume portion of the case, about pivot means substantially parallel to said plane of symmetry, the pivot means and the lever being symmetrically arranged with respect to the said plane of symmetry, the lever having pivoting ends and opposite ends, the pivoting ends being located nearer from the base member than the opposite ends;

c. first and second contact members mounted facing to each other at the respective opposite ends of the first and second levers;

d. first and second spring means mounted within the casing and each having a fixed end and an opposite end, the opposite ends of the spring means bearing on the respective opposite ends on the levers, the levers and the contact members being repelled from each other against the action of the spring means for a predetermined value of over-current;

e. an insulating blade of predetermined width, said blade having lower and upper edges;

f. means for slidably mounting said blade in said casing between the respective levers and providing electrical insulation between the respective levers in any position of said blade; compression spring means mounted in the case between the base member and the insulating blade;

g. an arc chute having a plurality of fins symmetrically arranged with respect to the plane of symmetry in a second inner volume portion of the case which is farther from the base member than the first volume portion, said plurality comprising two fins forming a gap therebetween about the said plane of symmetry in the extension of said blade;

locking means integrally movable with at least one lever and adapted, when the contact members are in mutual engagement, to lock the insulating blade into a rest position in which the upper edge of the blade is located in close proximity to the contact members, said locking means being adapted for releasing the blade when the contact members are separated by a minimal distance which equals the width of the blade, the blade then being moved by the compression spring means to an actuated position in which the said upper edge is engaged into the said gap.

2. A current limiting circuit breaker as claimed in claim 1, wherein the contact members have an insulating abutting surface portion which is located nearer from the pivoting ends of the levers than the rest of their surface, said surface portion forming the said locking means and stopping the upper edges of the blade when the contact members are in mutual engagement.

3. A current limiting circuit breaker as claimed in claim 1, wherein the said locking means comprise a hook formed on either of the two levers and cooperating with an aperture provided in the said blade, said hook projecting from a surface portion of the lever which is located nearer the pivot means than from the contact members.

4. A current limiting circuit breaker as claimed in claim 1, wherein the first spring means exerts on the first lever a force which substantially exceeds the force exerted by the second spring means on the second lever, the case has a fixed abutting surface and the first spring means applies the first lever against the said fixed abutting surface.

5. A current limiting circuit breaker as claimed in claim 1, wherein the said two fins are longer than the other fins of the said plurality.

6. A current limiting circuit breaker comprising:

a. an insulating case having a base member, a plane of symmetry substantially at right angles with the said base and first and second substantially parallel side walls at right angles with said base member and with said plane of symmetry;

b. first and second conducting levers pivotably mounted in a first inner volume portion of the case, about pivot means substantially parallel to said plane of symmetry, the pivot means and the lever being symmetrically arranged with respect to the said plane of symmetry, the lever having pivoting ends and opposite ends, the pivoting ends being located nearer from the base member than the opposite ends;

c. first and second contact members mounted facing to each other at the respective opposite ends of the first and second levers;

d. first and second spring means mounted within the casing and having a common axis of symmetry which is substantially at right angles with the plan of symmetry of the case, said spring means each having a fixed end and an opposite end, the opposite ends of the spring means bearing on the respective opposite ends on the levers, the levers and the contact members being repelled from each other against the action of the spring means for a predetermined value of overcurrent;

e. an insulating partition member secured between the levers substantially at right angles with said plane of symmetry and a slot provided in said partition member;

f. first and second grooves in said first and second side walls respectively, said grooves being located in said plane of symmetry;

g. first and second U-shaped magnetizable members mounted in the case and each having two legs, with the respective legs of the first and second U-shaped member at least partially encompassing the first and second levers, respectively;

h. an insulating blade of predetermined width said blade having lower and upper edges and being slidably mounted in said grooves and movable in said slot;

i. compression spring means mounted in the case between the base member and the insulating blade;

j. an arc chute having a plurality of fins symmetrically arranged with respect to the plane of symmetry in a second inner volume portion of the case which is farther from the base member than the first volume portion, said plurality comprising two fins forming a gap there between about the said plane of symmetry in the extension of said blade;

k. locking means integrally movable with at least one lever and adapted, when the contact members are in mutual engagement, to lock the insulating blade into a rest position in which the upper edge of the blade is located in close proximity to the contact members, said locking means being adapted for releasing the blade when the contact members are separated by a minimal distance which equals the width of the blade, the blade then being moved by the compression spring means to an actuated position in which the said upper edge is engaged into the said gap while the said lower edge is still engaged in the said grooves.

7. A current limiting circuit breaker as claimed in claim 6, wherein the case has third and fourth side walls substantially parallel to the said plane of symmetry and a further wall substantially parallel to said base member and opposite said base member, the fins radially extend from a first region of the said second inner volume portion of the case which is located nearer from the levers than from the said further wall, to a second region of the said second inner volume portion which is located nearer from the said further opposite wall than the said first region, gas discharge channels being formed within the case in the said second region and along the said third and fourth side walls and gas exhaust openings being formed in the said third and fourth lateral walls at locations nearer from the base member than from the further opposite wall.

8. A current limiting circuit breaker as claimed in claim 6, wherein the said insulating partition wall, the said slot and the said grooves are integrally made into a moulded insulating member which has housings for the said compression spring means.

* * * * *